US005878518A

United States Patent [19]

Grewe

[11] Patent Number: 5,878,518

[45] Date of Patent: Mar. 9, 1999

[54] SIGN STAND WITH ROLLING BASE

[75] Inventor: Ronald Grewe, Novi, Mich.

[73] Assignee: Marketing Displays, Inc., Farmington Hills, Mich.

[21] Appl. No.: 740,329

[22] Filed: Oct. 28, 1996

[51] Int. Cl.[6] ..... G09F 15/00

[52] U.S. Cl. ..... 40/606; 40/608; 248/910

[58] Field of Search ..... 40/606, 608, 610, 40/607, 612; 473/479; 248/129, 900, 910; 280/47.131, 47.17, 47.24, 47.27, 63; 312/249.8, 351.11; 16/47

[56] References Cited

U.S. PATENT DOCUMENTS 3,662,482 5/1972 Sarkisian .
4,033,536 7/1977 Hillstrom ..... 40/608 X
4,038,769 8/1977 Werner ..... 40/608 X
4,811,968 3/1989 Bolden ..... 280/63 X
5,088,680 2/1992 Farmer .
5,220,740 6/1993 Brault .
5,248,140 9/1993 Matherne et al. .
5,442,871 8/1995 Sarkisian et al. .

*Primary Examiner*—Brian K. Green

[57] ABSTRACT

A portable sign stand with rollers and an adjustable weighted base. The base member has one or more compartments so that liquid or solid ballast can be added to stabilize the sign stand in windy conditions. Wheels are provided on one edge of the base member in order to allow the sign stand to be rolled and easily moved to different positions. The axle member for the wheels is held in place on the base member by a bracket member which also helps secure the sign member to the base member. A pair of springs of the like can be used to connect the sign member to the base in order to provide a better wind-resistant sign stand.

58 Claims, 4 Drawing Sheets

SIGN STAND WITH ROLLING BASE

TECHNICAL FIELD

The present invention relates to portable sign stands which have a rolling base.

BACKGROUND OF THE INVENTION

Signs and sign stands are used for a variety of different purposes today with virtually all types of businesses. For example, signs and sign stands of various types are used for point of purchase displays, either interior or exterior to the establishment. Signs and sign stands are also used by the traffic control and safety industry to provide notice and/or warnings to passing pedestrians and motorists.

Many of the sign stands in use today are spring-mounted wind-resistant sign stands. Some of these are shown, for example, in U.S. Pat. Nos. 3,646,696, 3,662,482, 4,288,053, and 4,548,379. There also are numerous sign stands in use today which use T-shaped legs or weighted bases in order to keep them in place. Where weighted bases are used, it is often difficult to provide appropriate size and weight base in order to provide the best wind-resistance and yet, at the same time, allow the sign stands to be portable.

It is an object of the present invention to provide an improved sign stand which has a weighted base and is readily portable. It is also an object of the present invention to have a sign stand which has wheels or rollers for ease of placement and movement.

It is a further object of the present invention to provide a portable sign stand in which the weight of the base can be adjusted easily. It is still another object of the present invention to provide a portable sign stand which has a base member with a cavity therein so the cavity can be filled with a liquid or solid material in order to hold the sign stand in place and yet be emptied in order to allow the sign stand to be easily moved and stored.

These and other objects, and purposes of the present invention will become apparent from the following summary and descriptions of the invention.

SUMMARY OF THE INVENTION

The invention provides a portable sign stand with a base which can have the weight adjusted. The base has one or more compartments or cavities with inlet ports or openings in order to allow the compartments or cavities to be filled or emptied. Preferably, except for one or more sealed inlet/outlet ports, the base does not have any openings or joints which could cause leakage problems. A sign or sign stand, particularly a spring-mounted wind-resistant sign stand, is mounted to the base member.

One or more wheel s or rollers are provided in one of the sides of the base member to allow the base member and sign stand to be easily moved from one position to another.

These and other features, benefits and advantages of the present invention will become apparent from the following description of the invention, when viewed in accordance with the attached drawings and appended claims.

BEST MODE(S) OF THE INVENTION

Figure 1:
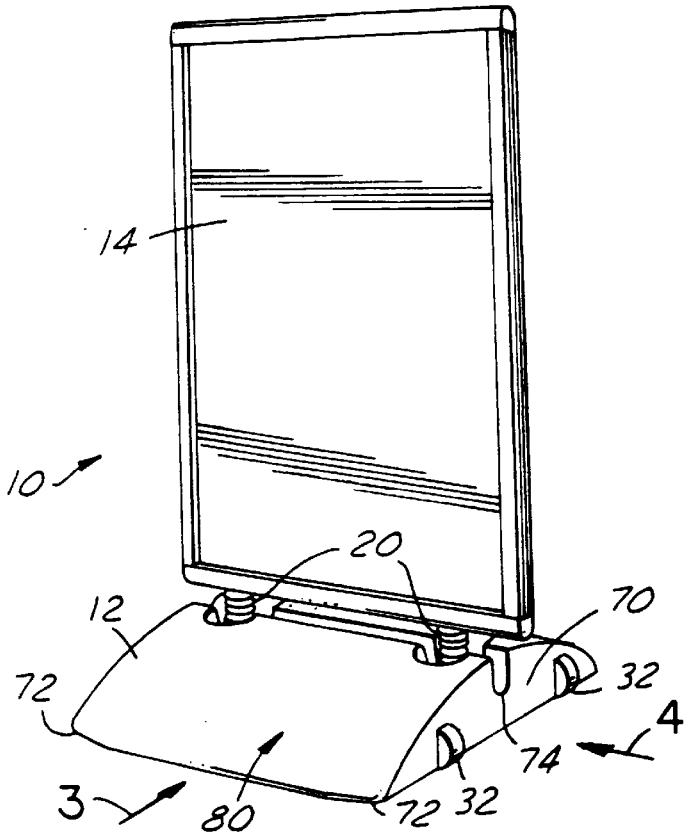
FIG. 1 illustrates a preferred embodiment of the present invention

The present invention is referred to generally by the numeral 10 in the drawings. The invention comprises a sign and sign stand apparatus having a weighted base member in which the weight can be adjusted and which has roller members in order to allow the sign stand to be easily moved from one position to another.

The sign stand 10 includes a base member 12 and an upright sign member 14. The sign member 14 is connected to the base member 12 by a pair of coil springs 20. Although the invention 10 is shown in the preferred embodiment utilizing a pair of coil springs 20 connecting the sign member 14 to the base member 12, it is also understood that the sign member can be connected to the base member in any conventional manner. In this regard, the connection means can provide a wind-resistant mounting, or the sign member can be connected solidly to the base member without allowing a provision for wind resistance.

Sign stands connected to base members with one or more spring members are disclosed, for example, in U.S. Pat. Nos. 3,646,696, 3,662,482, and 4,288,053, the disclosures of which are hereby incorporated by reference. Sign stands of this type are sold under the trademark WINDMASTER™ by Marketing Displays, Inc., Farmington Hills, Mich.

The base member 12 is preferably molded from a plastic material, such as polyethylene, polypropolene, or the like, although other equivalent materials which could fulfill the purposes and objects of the present invention could be utilized. The inside of the base member has one or more compartments or hollow chambers 22. One or more openings 24 are utilized to communicate with each of the chambers 22 so that they can be filled with a liquid or solid material, such as water, sand, or other ballast.

Although the base could be molded in two or more pieces and joined together, or molded in one piece with a plurality of openings or holes later machined into it, it is preferred that the base be molded in the size and configuration shown by rotational molding techniques. In this manner, openings or joints are unnecessary and the base can be provided without potential ballast leakage sites. Thus, in accordance with the preferred embodiment of the invention, the base has only one or more inlet/outlet ports for filling/emptying of the internal cavity or cavities, and these ports can be readily sealed with an appropriate plug and situated at a position where leakage is not a concern.

A single or multiple hollow portions or chambers can be provided in the interior of the base member 12. In this regard, if more than one chamber is provided, then it is preferred that each chamber have at least one opening 24 allowing access to the volume of each chamber. Also, there can be two or more ports or openings in each of the chambers for ease of filling and emptying, if desired.

Figure 3:
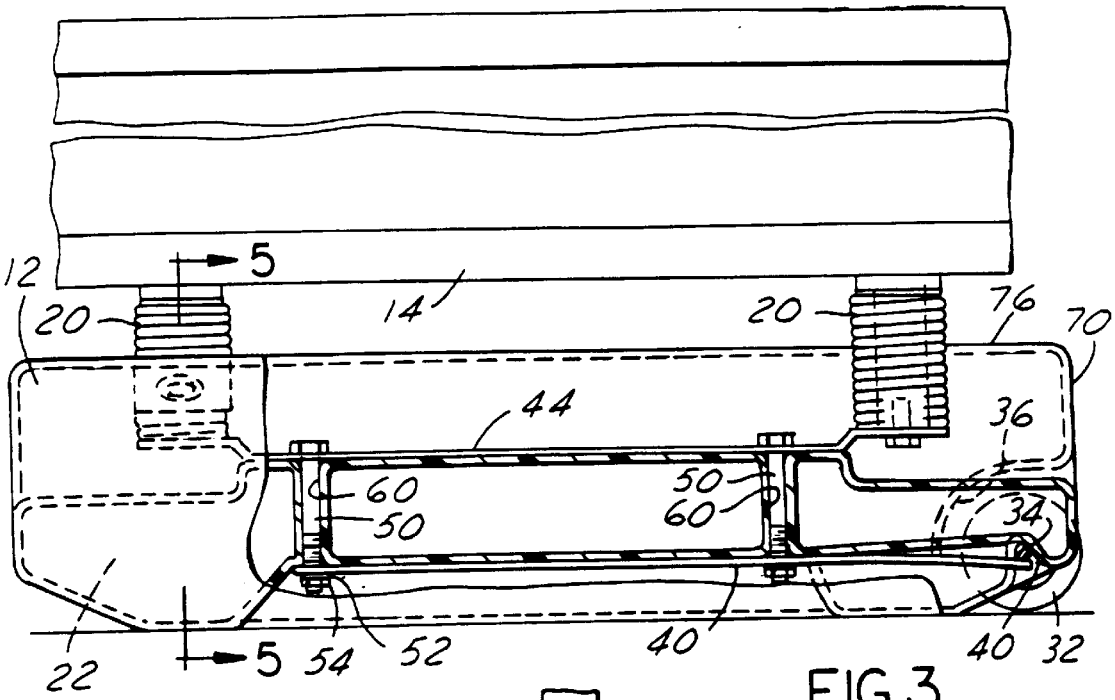
FIG. 3 is a cross-sectional view of a preferred embodiment of the base member in accordance with the present invention, the cross-section being taken along lines 3—3 in FIG. 2.
Figure 4:
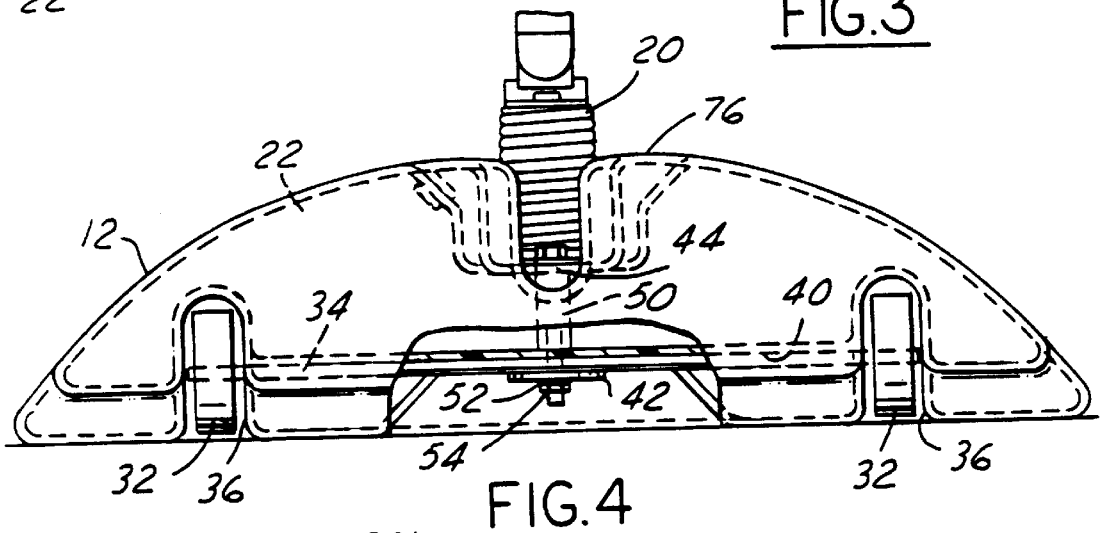
FIG. 4 is also a cross-sectional view of a preferred embodiment of the base member, the cross-section being taken along lines 4—4 in FIG. 2 and in the direction of the arrows.

FIGS. 3 and 4 illustrate cross-sectional views of a base member 12 which has one interior chamber 22.

A plug member 26 of any conventional type, preferably made of plastic or an elastomeric/rubber material, is provided to removably seal the opening 24.

Figure 6:
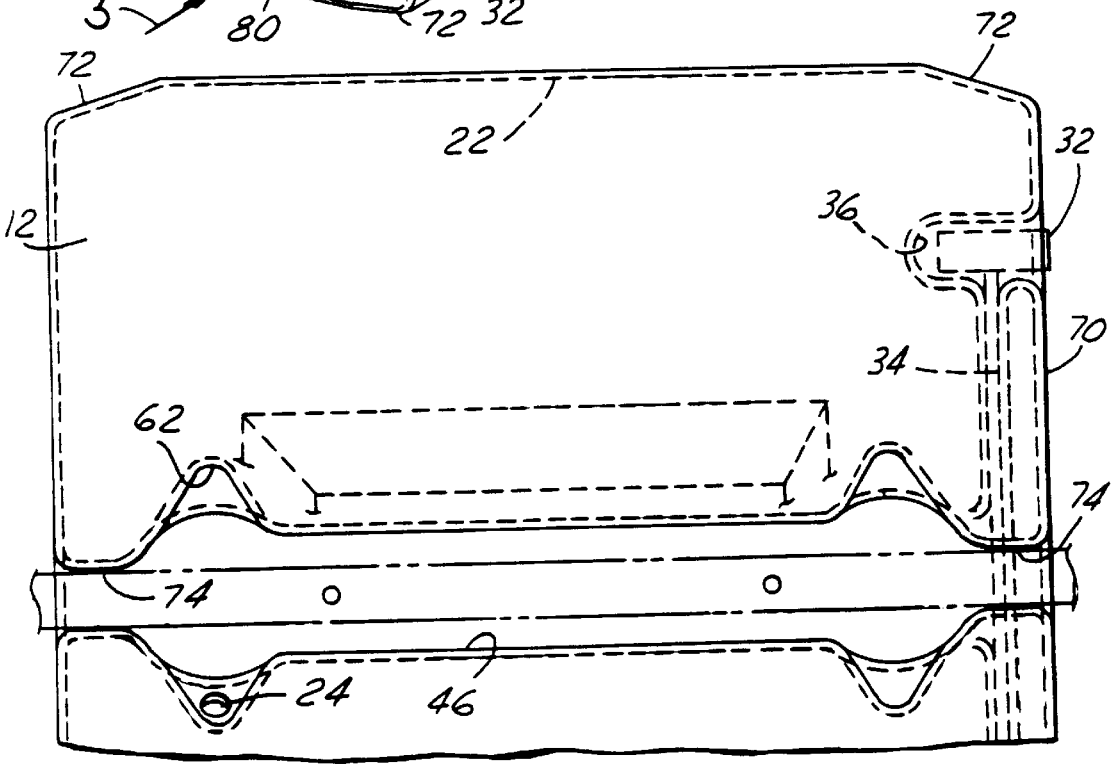
FIG. 6 is a partial top view of the base member.

When it is desired to fill the chambers in the base member with ballast, the sign stand 10 is preferably tipped over and positioned on its side, as shown in FIG. 6. In this manner, liquid such as water from a hose 28 can be introduced into the chamber through opening 24. Plug member 26 plugs the opening after the base member is filled with ballast.

Figure 7:
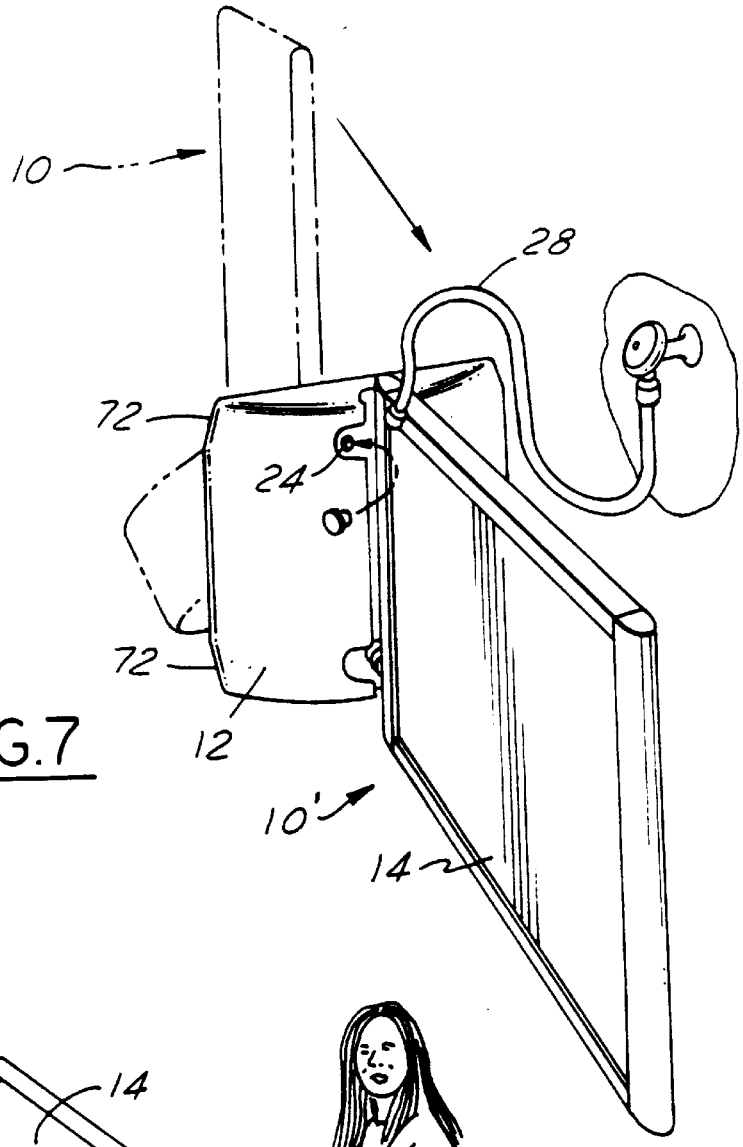
FIG. 7 depicts a preferred embodiment of the invention in a position to be filled with ballast.
Figure 8:
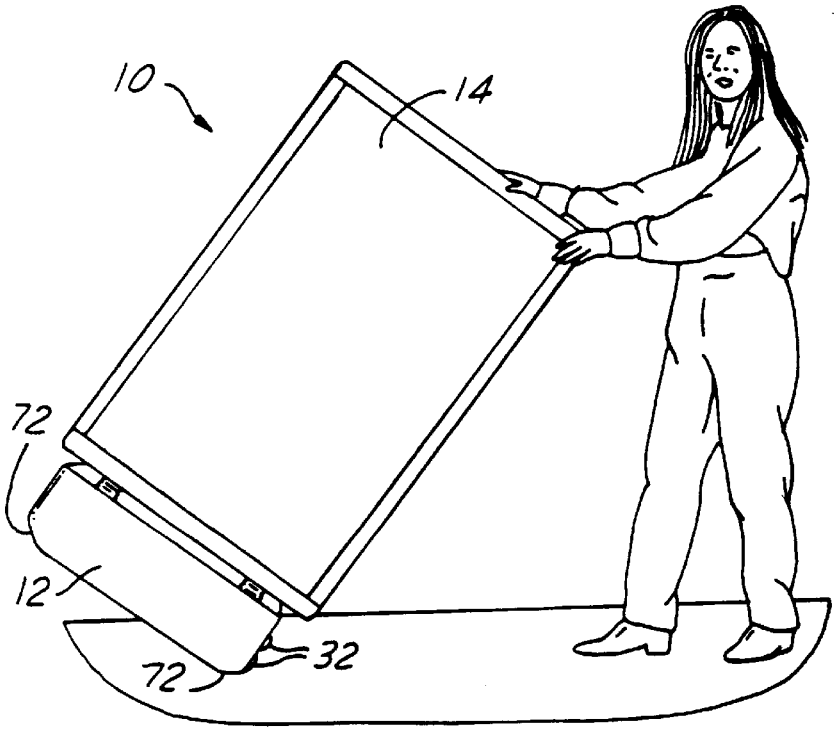
FIG. 8 illustrates the manner in which the invention can be moved from one position to another.

When it is desired to empty the base member 12, the sign stand 10 can be tipped over in the opposite manner to that shown in FIG. 7 so that the opening 24 is near the ground. This allows the liquid or solid ballast in the base member to flow out of opening 24.

Figure 2:
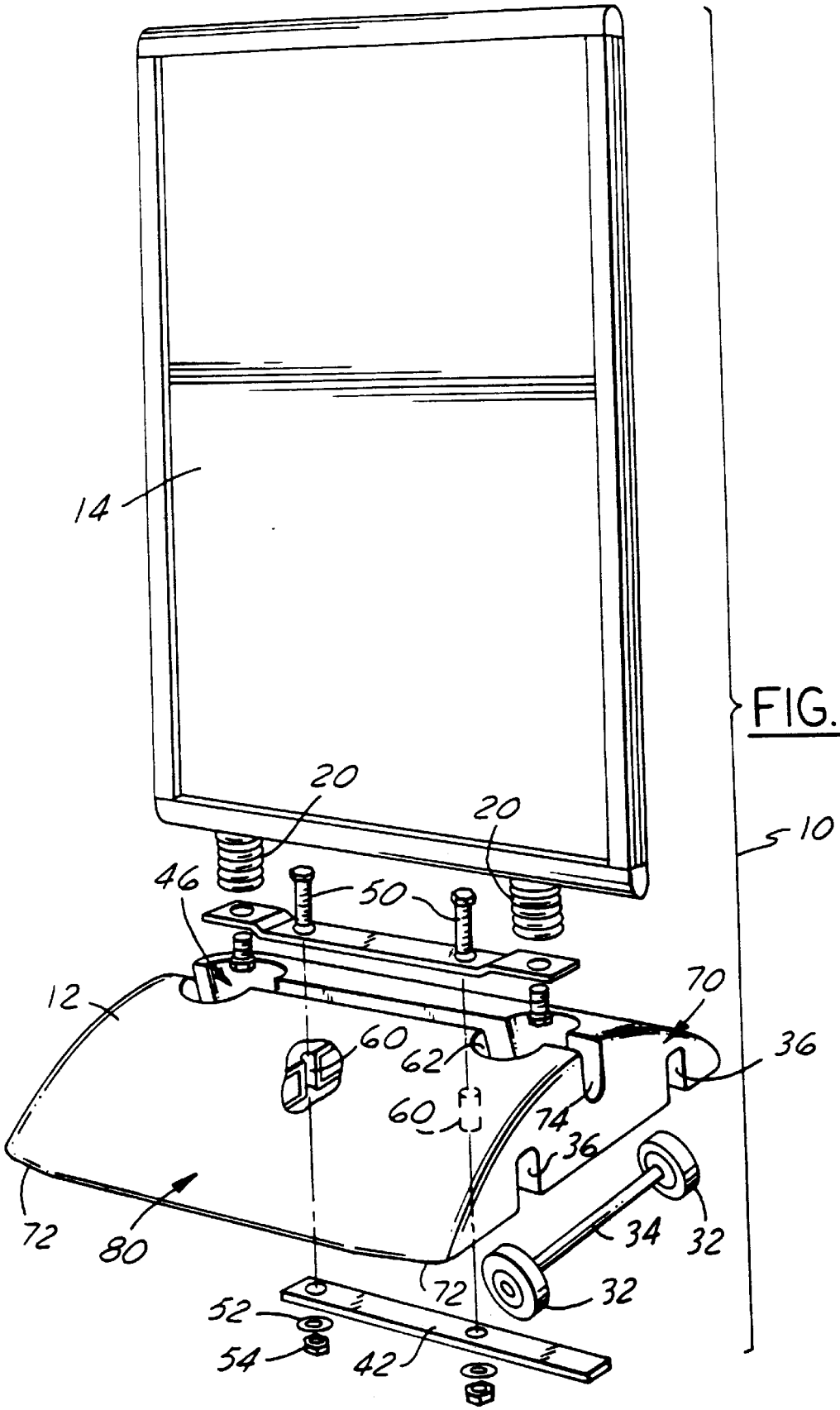
FIG. 2 is an exploded view of the embodiment illustrate d in FIG. 1.

As shown in FIG. 2, a pair of wheels 32 are connected to axle member 34 and positioned on the bottom of the base member 12. The wheels fit within molded recesses 36 in the base member. The axle is positioned in a slot or channel 40 in the base member and the axle member 34 is held in place by bracket member 42.

The coil spring members 20 are connected to the sign stand 14 in any conventional manner. As shown in the drawings, the spring members 20 are preferably connected to the base member 12 by bracket member 44 which is positioned in a channel 46 in the base member. The bracket members 42 and 44 are secured together on opposite sides of the base member 12 by a plurality of fasteners 50. The fasteners 50 can be of any conventional type, such as machine bolts as shown in FIG. 2. Washers 52 and nuts 54 are used to secure the fasteners 50 to the two plate members. The fasteners 50 are positioned in molded openings 60 in the base member 12.

In accordance with the preferred embodiment of the invention, it is unnecessary to drill holes in the base for the axle or bracket fasteners. The axle fits within an elongated molded recess and the fasteners are positioned in molded openings which provide sealed passageways through the base.

As shown, the bracket member 42 helps secure the sign stand 14 to the base member 12, and also holds the axle 34 and wheels 32 in place on the base member.

Figure 5:
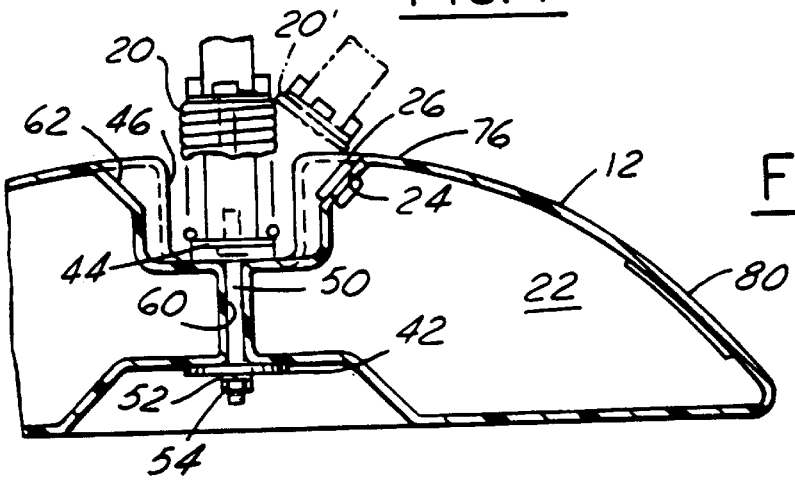
FIG. 5 is a cross-sectional view taken along lines 5—5 in FIG. 3 and in the direction of the arrows.

A pair of enlarged wells or openings 62 are also incorporated in the base member 12 and communicate with the central channel 46. The enlarged openings 62 allow for bending of the spring members 20 when the sign stand 14 is deflected by wind forces. This deflection is shown, for example, in hidden lines 201 in FIG. 5.

The wheels 32 are positioned on a side 70 of the base member and used to accommodate tipping of the sign stand 10 so it can be moved to other positions. The sign stand could be moved, for example, indoor for security or from one position to another merely for convenience. As shown in FIG. 7, in order to allow the sign stand 10 to be moved, the sign stand 10 is tipped slightly so that the wheel members 32 are fully engaged with the ground surface. In this position, as shown in FIG. 7, the sign stand can be moved in any direction.

Preferably, the corners 72 of the base member are angled or radiused as shown in the drawings in order to provide clearance for the base member to be tipped in the manner shown in FIG. 7. Although it is only necessary in this regard to angle the two corner members adjacent the wheels 32, it is preferred for aesthetic reasons to also angle the other two corners of the base member.

The channel 46 is preferably open at both ends 74 of the base member in order to allow drainage of water, snow or the like from the channel if the sign stand 10 is used outdoors.

Although the bracket member 44 and thus the connection between the springs 20 and the base member 12 is positioned in the channel member 46 several inches below the upper surface 76 of the base member, it is also understood that the sign member 14 could be connected in other manners to the upper surface 76 of the base member. However, providing the connection between the springs and the base member in a lower portion of a channel creates a lower center of gravity for the sign stand 10. A lower center of gravity makes the sign stand more stable in windy conditions.

Preferably, in accordance with the present invention, the hollow portions or chambers in the base member hold between five and ten gallons of liquid material or ballast. The weight of the material in containers or chambers of that size is believed to provide satisfactory stability in windy conditions for the sign stand.

The base member 12 can have any exterior size or shape, although the size and shape of the base member shown in the drawings is preferred at this time. In this regard, a base member of the type shown in the drawings also can have one or more surfaces 80 which could be used for advertising members or messages. The advertisements could be decals, inserts, embossing, or the like.

While the best modes for carrying out the invention have been described in detail, those familiar with the art to which this invention relates will recognize various alternative designs and embodiments for practicing the invention as defined by the following claims.

What is claimed is:

1. A portable sign device comprising:

a base member comprising a molded housing and having a hollow cavity, a lower surface and an upper surface;

an upright sign member positioned on said upper surface and having a first bracket member thereon;

a pair of wheel members connected together by an axle member, said wheel members being positioned on said lower surface;

a second bracket member positioned on said lower surface and securing said axle member to said housing;

at least one fastener member, said at least one fastener member extending entirely through said housing from said lower surface to said upper surface and connected to said first bracket member on said upper surface and to said second bracket member on said lower surface; and a recess in said upper surface and wherein said sign member is positioned in said recess.

2. The portable sign device of claim 1 wherein said sign member comprises a sign display member and a resilient mechanism, said resilient mechanism attached to said first bracket member.

3. The portable sign device of claim 2 wherein said resilient mechanism comprises a pair of coil spring members.

4. The portable sign device of claim 1 wherein said base member comprises a one-piece leakproof molded housing, said base member also having at least one leakproof channel member extending through said hollow cavity from said lower surface to said upper surface, and wherein said at least one fastener member is positioned in said channel member.

5. The portable sign device of claim 4 wherein two of said leakproof channel members and two of said fastener members are provided, said two fastener members being positioned in said two channel members, and wherein said two fastener members are each connected to said first bracket member on said upper surface and to said second bracket member on said lower surface.

6. The portable sign device of claim 1 wherein said sign member comprises a sign display member and at least one resilient member.

7. The portable sign device of claim 1 wherein two of said fastener members are provided, each of said fastener members connected to said first bracket member on said upper surface and to said second bracket member on said lower surface.

8. The portable sign device of claim 1 wherein said base member is substantially rectangular in shape and has at least one angled corner, wherein tipping of said base member can be accomplished more easily.

9. The portable sign device of claim 1 further comprising at least one spring member positioned between said sign member and said base member, wherein said sign member can deflect relative to said base member.

10. The portable sign device of claim 1 further comprising a recess in said lower surface and wherein said wheel members are positioned in said recess.

11. The portable sign device of claim 1 wherein said second bracket member secures said axle member and wheel members to said base member and at the same time in combination with said at least one fastener member securely holds said sign member to said base member.

12. The portable sign device of claim 1 wherein said base member has at least one opening therein for selective addition of a ballast in order to add stabilizing weight to said sign device.

13. A portable sign device comprising:

a base member comprising a molded housing with a hollow cavity and having a lower surface and an upper surface;

an upright sign member positioned on said upper surface and having a first bracket member thereon;

a pair of wheel members connected together by an axle member, said wheel members being positioned on said lower surface;

a second bracket member positioned on said lower surface and securing said axle member to said housing;

at least one fastener member, said at least one fastener member extending entirely through said housing from said lower surface to said upper surface and connected to said first bracket member on said upper surface and to said second bracket member on said lower surface; and said sign member comprising a sign display member and a resilient mechanism, said resilient mechanism attached to said first bracket member and comprising a pair of coil spring members.

14. The portable sign device of claim 13 further comprising a recess in said upper surface and wherein said sign member is positioned in said recess.

15. The portable sign device of claim 13 wherein said base member comprises a one-piece leakproof molded housing, said base member having at least one leakproof channel member extending through said hollow cavity from said lower surface to said upper surface, and wherein said at least one fastener member is positioned in said channel member.

16. The portable sign device of claim 15 wherein two of said leakproof channel members and two of said fastener members are provided, said two fastener members being positioned in said two channel members, and wherein said two fastener members are each connected to said first bracket member on said upper surface and to said second bracket member on said lower surface.

17. The portable sign device of claim 13 wherein said sign member comprises a sign display member and at least one resilient member.

18. The portable sign device of claim 13 wherein two of said fastener members are provided, each of said fastener members connected to said first bracket member on said upper surface and to said second bracket member on said lower surface.

19. The portable sign device of claim 13 wherein said base member is substantially rectangular in shape and has at least one angled comer, wherein tipping of said base member can be accomplished more easily.

20. The portable sign device of claim 13 further comprising at least one spring member positioned between said sign member and said base member, wherein said sign member can deflect relative to said base member.

21. The portable sign device of claim 13 further comprising a recess in said lower surface and wherein said wheel members are positioned in said recess.

22. The portable sign device of claim 13 wherein said second bracket member secures said axle member and wheel members to said base member and at the same time in combination with said at least one fastener member securely holds said sign member to said base member.

23. The portable sign device of claim 13 wherein said base member has at least one opening therein for selective addition of a ballast in order to add stabilizing weight to said sign device.

24. A portable sign device comprising:

a base member comprising a molded housing with a hollow cavity and having a lower surface and an upper surface;

an upright sign member positioned on said upper surface and having a first bracket member thereon;

a pair of wheel members connected together by an axle member, said wheel members being positioned on said lower surface;

a second bracket member positioned on said lower surface and securing said axle member to said housing;

at least one fastener member, said at least one fastener member extending entirely through said housing from said lower surface to said upper surface and connected to said first bracket member on said upper surface and to said second bracket member on said lower surface; and at least one spring member positioned between said sign member and said base member, wherein said sign member can deflect relative to said base member.

25. The portable sign device of claim 24 further comprising a recess in said upper surface and wherein said sign member is positioned in said recess.

26. The portable sign device of claim 24 wherein two of said spring members are provided.

27. The portable sign device of claim 24 wherein said spring member comprises a coil spring member.

28. The portable sign device of claim 24 wherein said base member comprises a one-piece leakproof molded housing, said base member having at least one leakproof channel member extending from said lower surface to said upper surface, and wherein said at least one fastener member is positioned in said channel member.

29. The portable sign device of claim 28 wherein two of said leakproof channel members and two of said fastener members are provided, said two fastener members being positioned in said two channel members, and wherein said two fastener members are each connected to said first bracket member on said upper surface and to said second bracket member on said lower surface.

30. The portable sign device of claim 24 wherein two of said fastener members are provided, each of said fastener members connected to said first bracket member on said upper surface and to said second bracket member on said lower surface.

31. The portable sign device of claim 24 wherein said base member is substantially rectangular in shape and has at least one angled corner, wherein tipping of said base member can be accomplished more easily.

32. The portable sign device of claim 24 further comprising a recess in said lower surface and wherein said wheel members are positioned in said recess.

33. The portable sign device of claim 24 wherein said second bracket member secures said axle member and wheel members to said base member and at the same time in combination with said at least one fastener member securely holds said sign member to said base member.

34. The portable sign device of claim 24 wherein said base member has at least one opening therein for selective addition of a ballast in order to add stabilizing weight to said sign device.

35. A portable sign device comprising:

a base member comprising a molded housing with a hollow cavity therein and having a lower surface and an upper surface;

an upright sign member positioned on said upper surface and having a first bracket member thereon;

a pair of wheel members connected together by an axle member, said wheel members being positioned on said lower surface;

a second bracket member positioned on said lower surface and securing said axle member to said housing;

at least one fastener member, said at least on fastener member extending entirely through said housing from said lower surface to said upper surface and connected to said first bracket member on said upper surface and to said second bracket member on said lower surface; and a recess in said lower surface and wherein said wheel members are positioned in said recess.

36. The portable sign device of claim 35 further comprising a recess in said upper surface and wherein said sign member is positioned in said recess.

37. The portable sign device of claim 35 wherein said sign member comprises a sign display member and a resilient mechanism, said resilient mechanism attached to said first bracket member.

38. The portable sign device of claim 37 wherein said resilient mechanism comprises a pair of coil spring members.

39. The portable sign device of claim 35 wherein said base member comprises a one-piece leakproof molded housing, said base member having at least one leakproof channel member extending through said hollow cavity from said lower surface to said upper surface, and wherein said at least one fastener member is positioned in said channel member.

40. The portable sign device of claim 39 wherein two of said leakproof channel members and two of said fastener members are provided, said two fastener members being positioned in said two channel members, and wherein said two fastener members are each connected to said first bracket member on said upper surface and to said second bracket member on said lower surface.

41. The portable sign device of claim 35 wherein said sign member comprises a sign display member and at least one resilient member.

42. The portable sign device of claim 35 wherein two of said fastener members are provided, each of said fastener members connected to said first bracket member on said upper surface and to said second bracket member on said lower surface.

43. The portable sign device of claim 35 wherein said base member is substantially rectangular in shape and has at least one angled corner, wherein tipping of said base member can be accomplished more easily.

44. The portable sign device of claim 35 further comprising at least one spring member positioned between said sign member and said base member, wherein said sign member can deflect relative to said base member.

45. The portable sign device of claim 35 wherein said second bracket member secures said axle member and wheel members to said base member and at the same time in combination with said at least one fastener member securely holds said sign member to said base member.

46. The portable sign device of claim 35 wherein said base member has at least one opening therein for selective addition of a ballast in order to add stabilizing weight to said sign device.

47. A portable sign device comprising:

a base member comprising a one-piece leakproof molded housing with a hollow cavity therein and having a lower surface and an upper surface;

an upright sign member positioned on said upper surface and having a first bracket member thereon;

a pair of wheel members connected together by an axle member, said wheel members being positioned on said lower surface;

a second bracket member positioned on said lower surface and securing said axle member to said housing;

at least one leakproof channel member extending through said hollow cavity from said lower surface to said upper surface, and at least one fastener member, said at least one fastener member being positioned in said at least one leakproof channel member and extending entirely through said hollow cavity from said lower surface to said upper surface and connected to said first bracket member on said upper surface and to said second bracket member on said lower surface.

48. The portable sign device of claim 47 further comprising a recess in said upper surface and wherein said sign member is positioned in said recess.

49. The portable sign device of claim 47 wherein said sign member comprises a sign display member and a resilient mechanism, said resilient mechanism attached to said first bracket member.

50. The portable sign device of claim 47 wherein said resilient mechanism comprises a pair of coil spring members.

51. The portable sign device of claim 47 wherein two of said leakproof channel members and two of said fastener members are provided, said two fastener members being positioned in said two channel members, and wherein said two fastener members are each connected to said first bracket member on said upper surface and to said second bracket member on said lower surface.

52. The portable sign device of claim 47 wherein said sign member comprises a sign display member and at least one resilient member.

53. The portable sign device of claim 47 wherein two of said fastener members are provided, each of said fastener members connected to said first bracket member on said upper surface and to said second bracket member on said lower surface.

54. The portable sign device of claim 47 wherein said base member is substantially rectangular in shape and has at least one angled corner, wherein tipping of said base member can be accomplished more easily.

55. The portable sign device of claim 47 further comprising at least one spring member positioned between said sign member and said base member, wherein said sign member can deflect relative to said base member.

56. The portable sign device of claim 47 further comprising a recess in said lower surface and wherein said wheel members are positioned in said recess.

57. The portable sign device of claim 47 wherein said second bracket member secures said axle member and wheel members to said base member and at the same time in combination with said at least one fastener member securely holds said sign member to said base member.

58. The portable sign device of claim 47 wherein said base member has at least one opening therein for selective addition of a ballast in order to add stabilizing weight to said sign device.

* * * * *